US008073146B2

(12) United States Patent
Cheng et al.

(10) Patent No.: US 8,073,146 B2
(45) Date of Patent: Dec. 6, 2011

(54) AUDIO TEST APPARATUS AND TEST METHOD THEREOF

(75) Inventors: Hua-Dong Cheng, Shenzhen (CN); Wen-Chuan Lian, Taipei Hsien (TW); Yao Zhao, Shenzhen (CN); Jian Sun, Shenzhen (CN); Peng Chen, Shenzhen (CN); Wen-Sheng Tsai, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 819 days.

(21) Appl. No.: 12/168,916

(22) Filed: Jul. 8, 2008

(65) Prior Publication Data

US 2009/0052678 A1 Feb. 26, 2009

(30) Foreign Application Priority Data

Aug. 24, 2007 (CN) ..... 2007 1 0076573

(51) Int. Cl.
*H04R 29/00* (2006.01)

(52) U.S. Cl. ..... 381/56; 381/58; 381/59; 381/98; 700/94

(58) Field of Classification Search ..... None
See application file for complete search history.

(56) References Cited

U.S. PATENT DOCUMENTS

2008/0144847 A1* 6/2008 Chen et al. ..... 381/58
2009/0080668 A1* 3/2009 Zhou et al. ..... 381/58
2009/0280800 A1* 11/2009 Liu et al. ..... 455/425
2009/0316917 A1* 12/2009 Lo et al. ..... 381/58

* cited by examiner

*Primary Examiner* — Minh-Loan T Tran
(74) *Attorney, Agent, or Firm* — Altis Law Group, Inc.

(57) ABSTRACT

An audio test apparatus, and an exemplary audio test method that includes: processing an audio file through two independent channels; outputting no signals from a left channel and from a right channel in a first time period; receiving noise signals from the left and right channels; outputting single-frequency signals from the left channel only in a second time period; receiving the single-frequency signals from the left channel and crosstalk signals from the right channel; outputting multi-frequency signals from the left and right channels in a third time period; receiving the multi-frequency signals from the left and right channels; outputting single-frequency signals from the right channel only in a fourth time period; receiving the crosstalk signals from the left channel and the single-frequency signals from the right channel; and testing parameters according to the signals received during the four time periods.

11 Claims, 8 Drawing Sheets

AUDIO TEST APPARATUS AND TEST METHOD THEREOF

BACKGROUND

1. Technical Field

The present invention relates to an audio test apparatus capable of decreasing test time in audio devices and a test method thereof.

2. General Background

Nowadays, handheld devices (e.g., mobile phones) are becoming more popular and multifunctional. Although mobile phones are primarily used as a means of communication, people typically use the mobile phone to listen to music. As a result, the sound quality outputted by handheld devices is an important factor in determining user satisfaction. The quality of the audio port of the mobile phone, such as an earphone port, directly correlates to the overall sound quality. Therefore, it is necessary to test and verify the quality of the mobile phone's audio port.

In general, testing the quality of the audio port is accomplished by receiving the audio signal outputted by the audio port and analyzing parameters of the audio signal. These parameters include signal to noise ratio (SNR), total harmonic distortion (THD), and frequency response (FR). The general method is to test different parameters by outputting different audio signals for the different tests. The general method is time consuming.

Therefore, an audio test apparatus that reduces test time and a test method are desired to overcome the above-identified deficiencies.

SUMMARY

An audio test method includes processing a media test file through two independent channels. In a first time period, no signals are outputted from the first and second channels. Noise signals from the first and second channels are collected, converted into digital noise signals, and stored in a storage unit. In a second time period, single-frequency signals are outputted from the first channel and no signal is outputted from the second channel. Single-frequency signals from the first channel and crosstalk signals from the second channel are received, converted into digital single-frequency signals and digital crosstalk signals, and stored in the storage unit. In a third time period, multi-frequency signals are outputted from the first channel and the second channel. Multi-frequency signals from the first and second channel are received, converted into digital multi-frequency signals, and stored in the storage unit. In a fourth time period, no signals are outputted from the first channel and single-frequency signals are outputted from the second channel. The crosstalk signals from the first channel and the single-frequency signals from the second channel are received, converted into digital crosstalk signals and digital single-frequency signals, and stored in the storage unit. Tests are performed during the four time periods.

An audio test apparatus is also provided.

Other advantages and novel features will become more apparent from the following detailed description of embodiments when taken in conjunction with the accompanying drawings.

BRIEF DESCRIPTION OF THE DRAWINGS

The components in the drawings are not necessarily drawn to scale, the emphasis instead being placed upon clearly illustrating the principles of the test apparatus and test method. Moreover, in the drawings, like reference numerals designate corresponding parts throughout the various views.

DETAILED DESCRIPTION OF THE EMBODIMENTS

Figure 1:
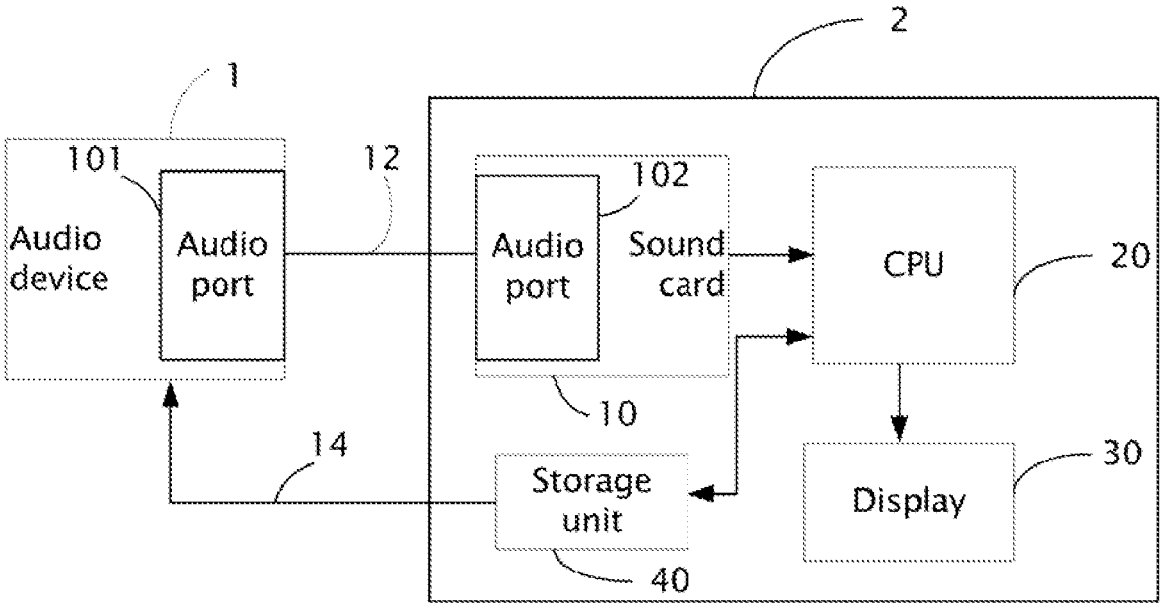
FIG. 1 is a block diagram of an audio test apparatus in accordance with an embodiment of the present invention.

Referring now to the drawings in detail, FIG. 1 is a block diagram of an audio test apparatus 2 in accordance with an exemplary embodiment of the present invention. The audio test apparatus 2 includes an audio collection device 10, a central processing unit (CPU) 20, a display 30, and a storage unit 40. The storage unit 40 stores a media test file. The audio collection device 10 is a sound card 10 in the exemplary embodiment of the present invention. An audio device 1 is an electronic device equipped with an audio port 101 and a data interface (not shown). The data interface can be a USB interface or an IEEE 1394 interface. The audio port 101 is used to output audio signals to a transducer (not shown). In the exemplary embodiment of the present invention, the audio device 1 is a mobile phone or a media player, and the audio port 101 is a dual channel headphone interface equipped with a first channel (a path over which audio signals can pass) and a second channel.

The audio device 1 is connected to the audio test apparatus 2 via a data cable 14. The data cable 14 facilitates data transfer of a media test file (not shown) from the audio test apparatus 1 to the audio device 2. The audio port 101 is connected to an audio port 102 of the audio test apparatus 2 via an audio cable 12. The audio device 1 processes the media test file and produces analog audio signals. The audio port 101 outputs the analog audio signals and transmits the analog audio signals to the sound card 10 through the audio cable 12. The sound card 10 converts the analog audio signals into digital audio signals and transmits the digital audio signals to the CPU 20. The CPU 20 stores the digital audio signals in the storage unit 40. The CPU 20 tests the parameters of the first channel and the second channel according to the digital audio signals. These parameters include signal to noise ratio (SNR), crosstalk, total harmonic distortion (THD), full-scale distortion, and frequency response (FR). After testing the parameters, the CPU 20 outputs the test results to the display 30 and stores the test results in the storage unit 40.

The media test file includes a plurality of data sections. For example, the preset data sections include a first data section, a second data section, a third data section, and a fourth data section. The first data section of the media test file is configured for the first channel and the second channel of the audio device 1 has no signals when processed. The second data section of the media test file is configured for the first channel outputs single-frequency signals and the second channel does not output signals when processed. The third data section of the media test file is configured for the first and second channels output multi-frequency signals when processed. The fourth data section of the media test file is configured for the first channel does not output signals and the second channel outputs single-frequency signals when processed.

In one embodiment of the present invention, the first channel corresponds to a left channel and the second channel corresponds to a right channel. In another embodiment of the present invention, the first channel and the second channel may correspond to the right channel and the left channel, respectively.

Figure 2:
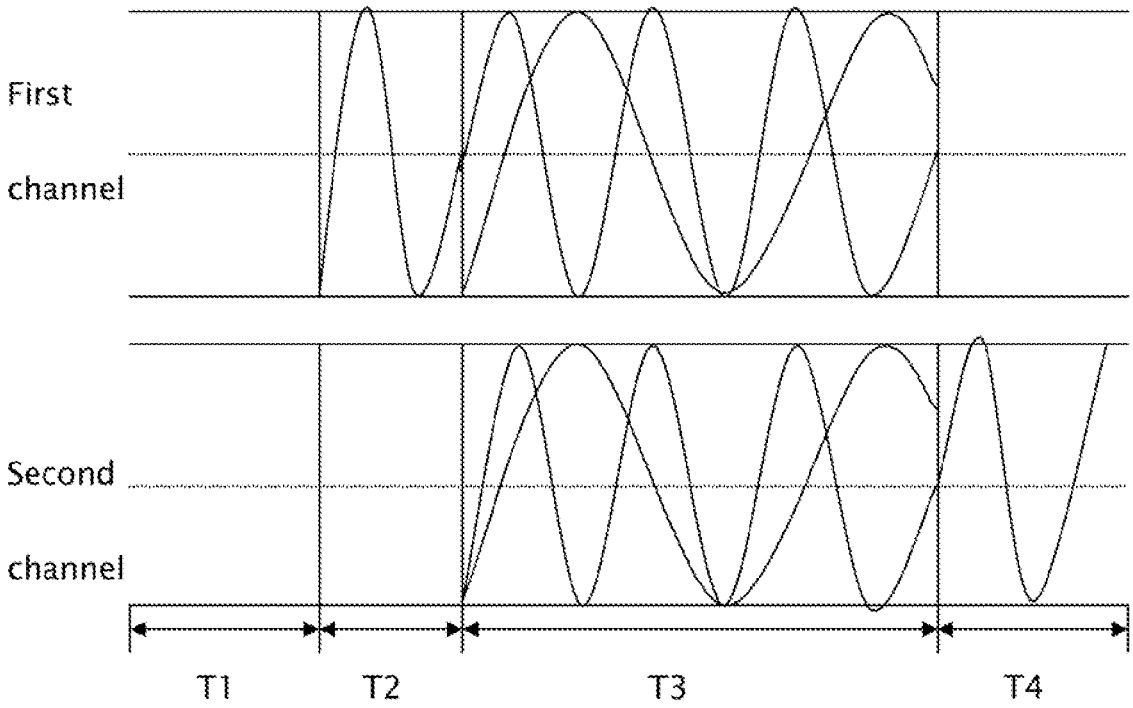
FIG. 2 is a sketch diagram of an audio signal outputted by the audio device in accordance with an embodiment of the present invention.

FIG. 2 is a sketch diagram of waveforms of audio signals outputted by the audio device 1 of an embodiment of the invention. In a first time period T1, the first channel and the second channel do not output signals. In a second time period T2, the first channel outputs single-frequency signals and the second channel does not output signals. In a third time period T3, the first channel and the second channel output multi-frequency signals. In a fourth time period T4, the first channel does not output signals and the second channel outputs single-frequency signals.

Figure 3:
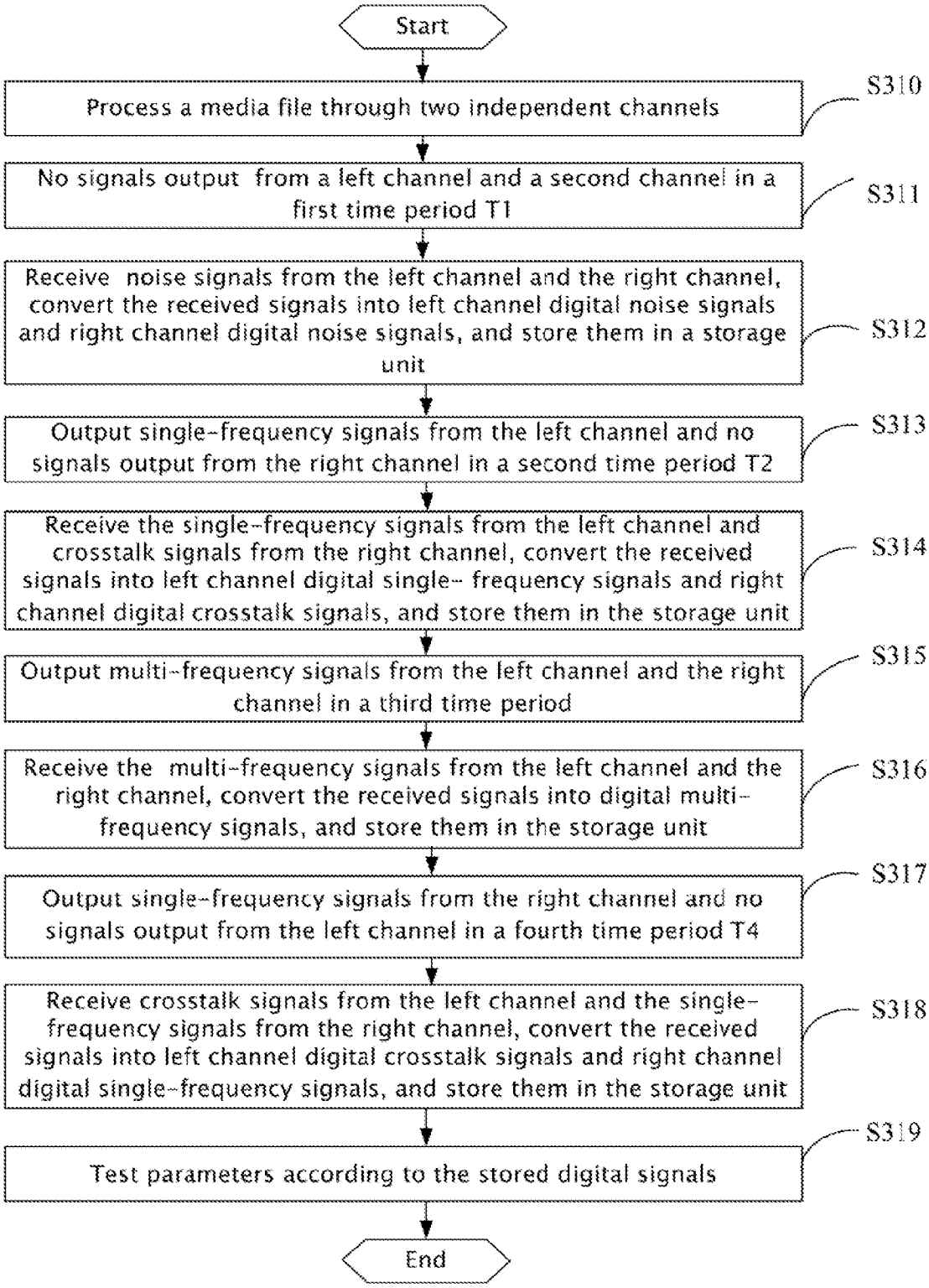
FIG. 3 is a flowchart illustrating an audio test method of an embodiment of the present invention.

FIG. 3 is a flowchart illustrating an audio test method of an embodiment of the present invention. In step S310, the audio test apparatus 2 transfers the media test file to the audio device 1, and the audio device 1 processes the media test file to produce the analog audio signals and outputs the analog audio signals through the left channel and the right channel of the audio port 101.

Step S311 reflects the first time period T1, when the left channel and the right channel do not output signals.

In step S312, the sound card 10 receives noise signals from the left and right channels during the first time period and converts the noise signals of the left channel into left channel digital noise signals and the noise signals of the right channel into right channel digital noise signals. The left channel digital noise signals and right channel digital noise signals are stored in the storage unit 40 by the CPU 20.

Step S313 reflects the second time period T2, when the left channel outputs a single-frequency signal and the right channel does not output signals.

In step S314, the sound card 10 receives single-frequency signals from the left channel and crosstalk signals from the right channel during the second time period and converts the single-frequency signals into left channel digital single-frequency signals and the crosstalk signals into right channel digital crosstalk signals. The left channel digital single-frequency signals and right channel digital crosstalk signals are stored in the storage unit 40 by the CPU 20.

Step S315 reflects the third time period T3, when the left channel and the right channel output multi-frequency signals.

In step S316, the sound card 10 receives the multi-frequency signals from the left and right channels of the audio port 101 during the third time period and converts the multi-frequency signals into left channel digital multi-frequency signals and right channel digital multi-frequency signals. The left channel digital multi-frequency signal and the right channel digital multi-frequency signals are then stored in the storage unit 40 by the CPU 20.

Step S317 reflects the fourth time period T4, when the left channel does not output signals and the right channel outputs single-frequency signals.

In step S318, the sound card 10 receives crosstalk signals from the left channel and the single-frequency signals from the right channel during the fourth time period and converts the left channel crosstalk signals into left channel digital crosstalk signals and the right channel single-frequency signals into right channel digital single-frequency signals. The left channel digital crosstalk signals and the right channel digital single-frequency signals are then stored in the storage unit 40 by the CPU 20.

In step S319, the CPU 20 tests the parameters of the left channel and the right channel according to the digitalized data generated during the time periods correspondingly.

After testing the parameters, the display 30 displays the results of the parameters.

Figure 4:
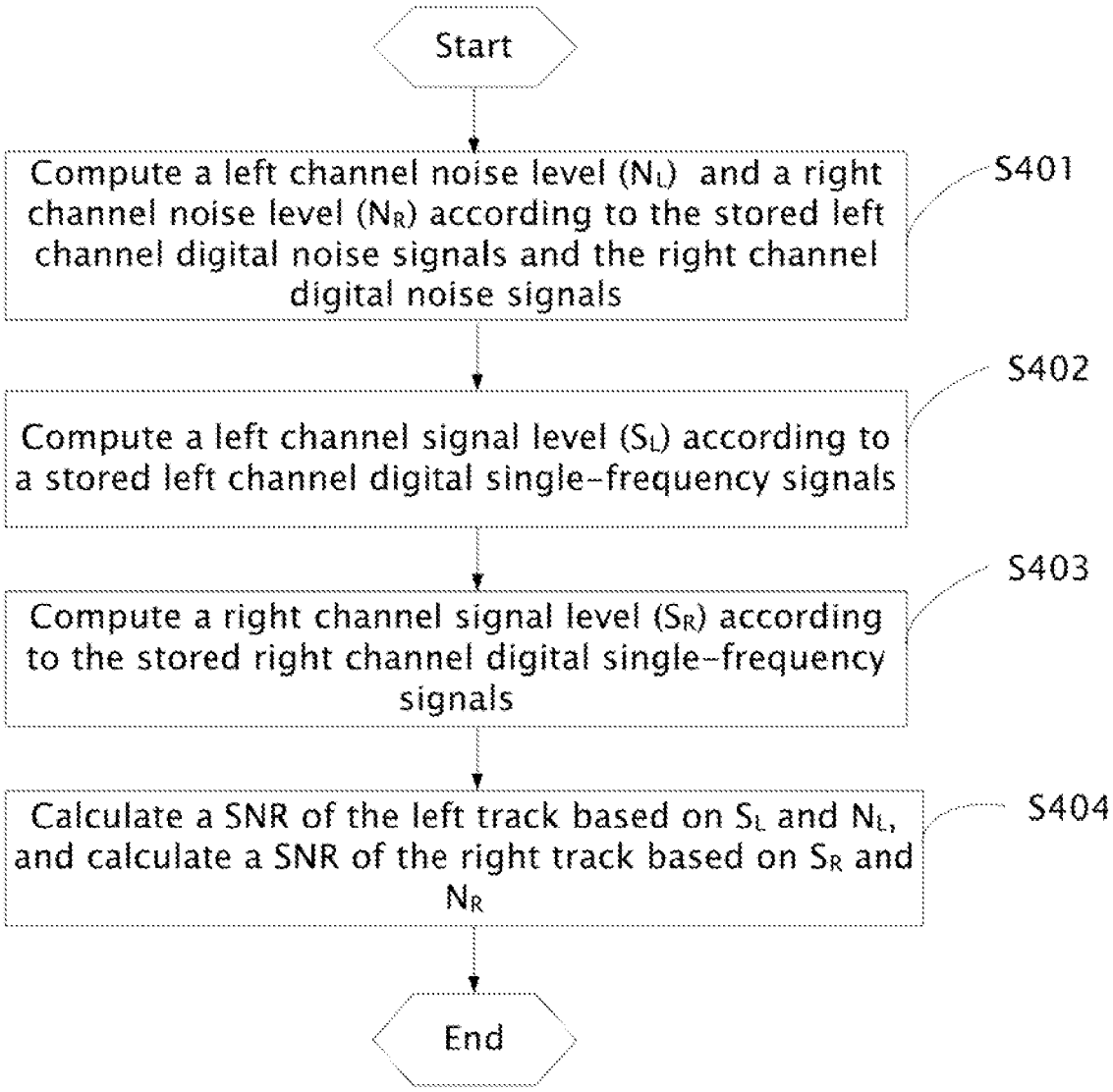
FIG. 4 is a flowchart illustrating a signal to noise ratio test method of an embodiment of the present invention.

FIG. 4 is a flowchart illustrating an SNR test method of an embodiment of the present invention. In step S401, the CPU 20 computes a left channel noise level $N_L$ according to the left channel digital noise signals, and computes a right channel noise level $N_R$ according to the right channel digital noise signals generated during the first time period T1.

In step S402, the CPU 20 computes a left channel signal level $S_L$ according to the left channel digital single-frequency signals generated during the second time period T2.

In step S403, the CPU 20 computes a right channel signal level $S_R$ according to the right channel digital single-frequency signals generated during the fourth time period T4.

In step S404, the CPU 20 calculates an SNR of the left channel using the formula: $SNR_L=20\lg(S_L/N_L)$, and calculates an SNR of the right channel using the formula: $SNR_R=20\lg(S_R/N_R)$.

Figure 5:
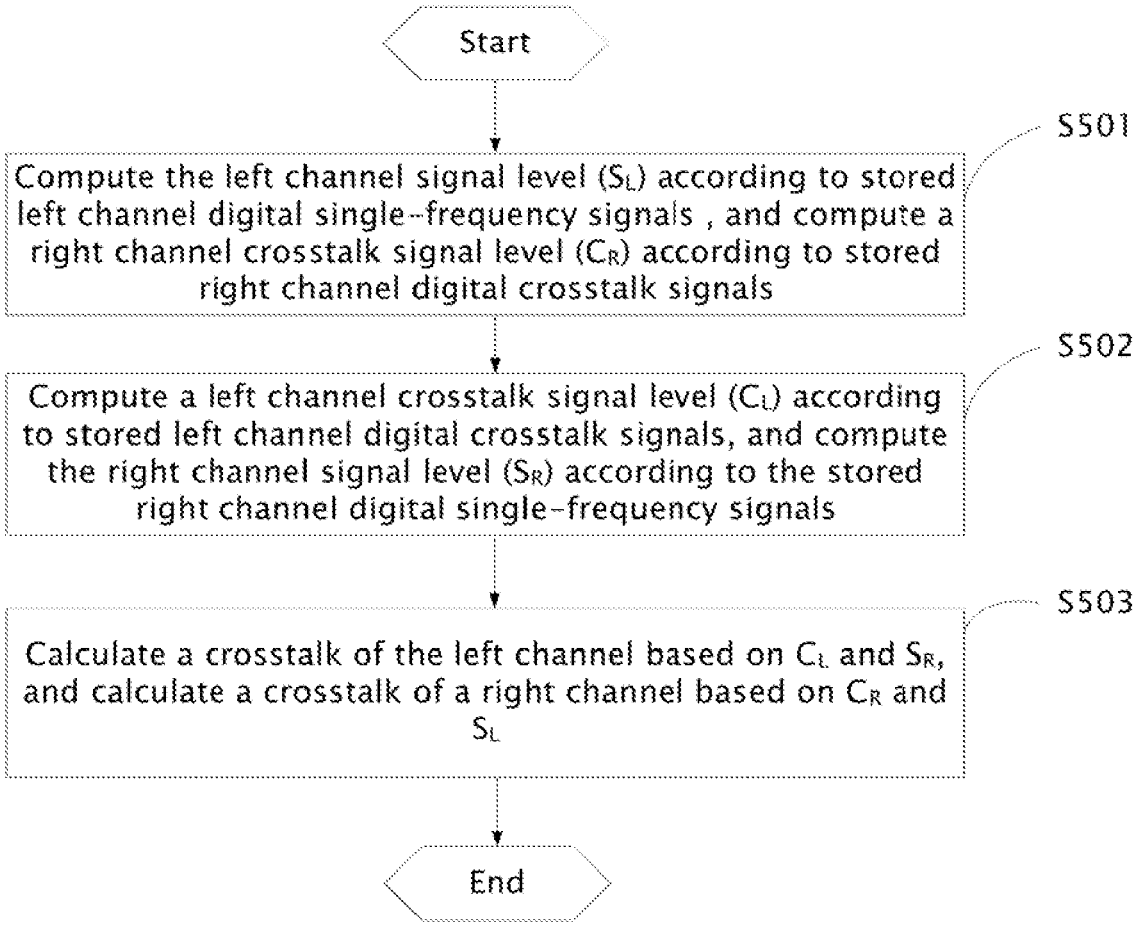
FIG. 5 is a flowchart illustrating a crosstalk test method of an embodiment of the present invention.

FIG. 5 is a flowchart illustrating a crosstalk test method of an embodiment of the present invention. In step S501, the CPU 20 computes the left channel signal level $S_L$ according to the left channel digital single-frequency signals generated during the second time period T2, and computes a right channel crosstalk signal level $C_R$ according to the right channel digital crosstalk signals generated during the second time period T2.

In step S502, the CPU 20 computes a left channel crosstalk signal level $C_L$ according to the left channel digital crosstalk signals generated during the fourth time period T4, and computes the right channel signal level $S_R$ according to the right channel digital single-frequency signals generated during the fourth time period T4.

In step S503, the CPU 20 calculates crosstalk $CT_L$ of the left channel using the formula: $CT_L=20\lg(C_L/S_R)$, and calculates crosstalk $CT_R$ of the right channel using the formula: $CT_R=20\lg(C_R/S_L)$).

Figure 6:
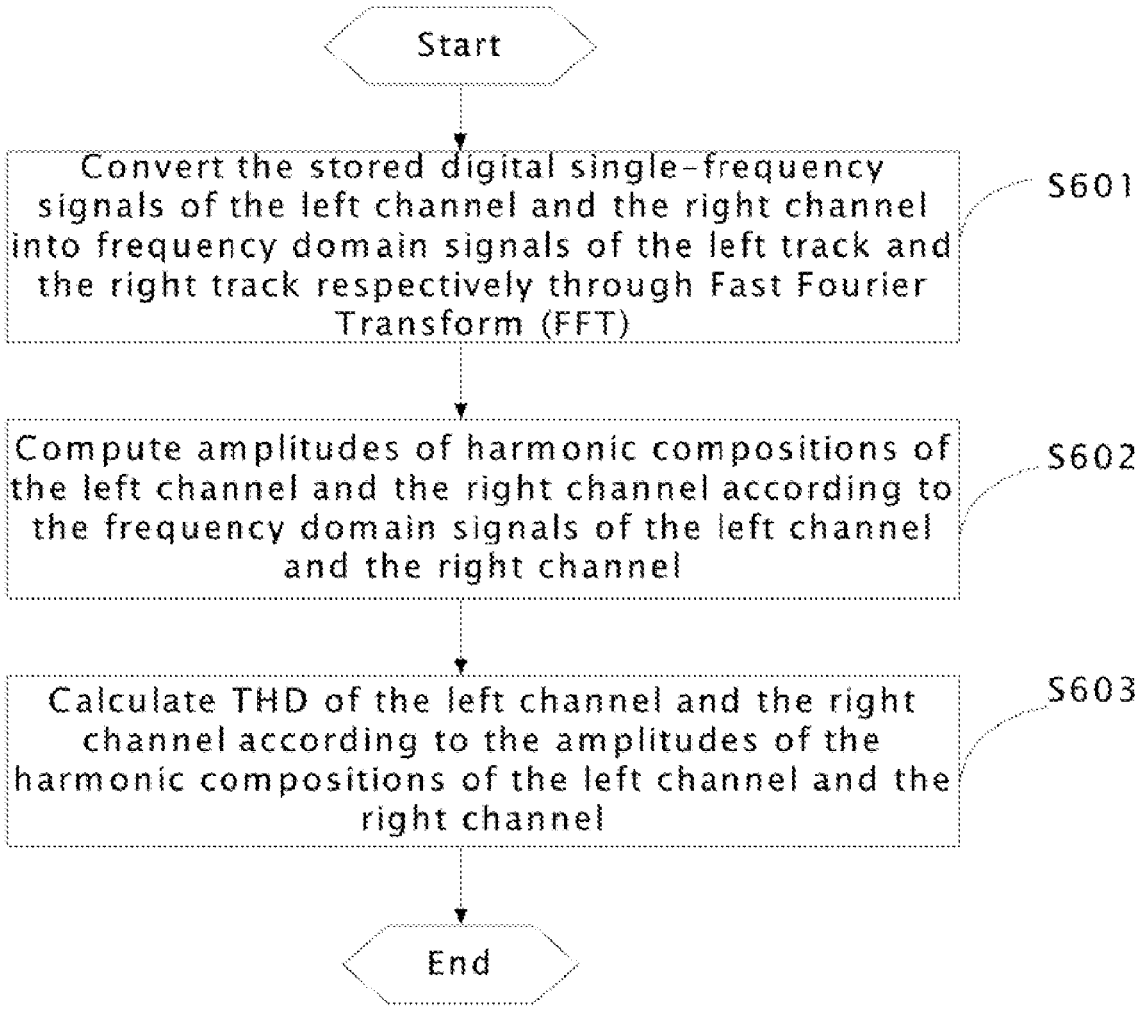
FIG. 6 is a flowchart illustrating a total harmonic distortion test method of an embodiment of the present invention.

FIG. 6 is a flowchart illustrating a total harmonic distortion test method of an embodiment of the present invention. In step S601, the CPU 20 converts the left channel digital single-frequency signals into left channel frequency domain signals and the right channel digital single-frequency signals into right channel frequency domain signals using a Fast Fourier Transform (FFT).

In step S602, the CPU 20 obtains amplitudes ($H_{Li}$(i=1, 2 . . . , N)) of harmonic compositions of the left channel frequency domain signals and amplitudes ($H_{Ri}$(i=1, 2 . . . , N)) of harmonic compositions of the right channel frequency domain signals.

In step S603, the CPU 20 calculates THD of the left channel using the formula:

$$THD_L = \sqrt{(H_{L2}^2 + H_{L3}^2 + \ldots + H_{LN}^2)/(H_{L1}^2 + H_{L2}^2 + H_{L3}^2 + \ldots + H_{LN}^2)}$$

and calculates THD of the right channel using the formula:

$$THD_R = \sqrt{(H_{R2}^2 + H_{R3}^2 + \ldots + H_{RN}^2)/(H_{R1}^2 + H_{R2}^2 + H_{R3}^2 + \ldots + H_{RN}^2)}.$$

Figure 7:
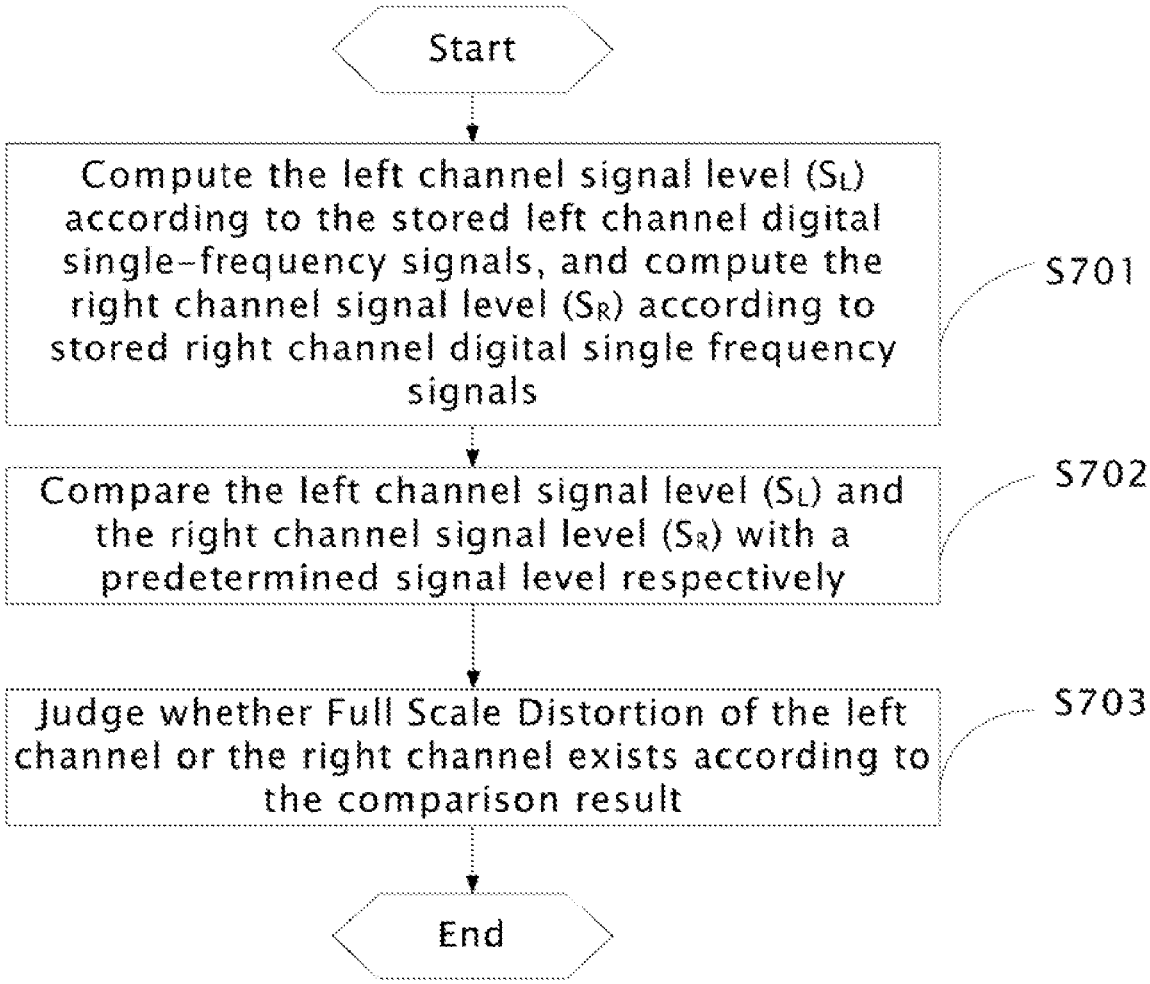
FIG. 7 is a flowchart illustrating a full scale distortion test method of an embodiment of the present invention.

FIG. 7 is a flowchart illustrating a Full Scale distortion test method of an embodiment of the present invention. In step S701, the CPU 20 computes the left channel signal level $S_L$ according to the left channel digital single-frequency signals generated during the second time period T2 and computes the right channel signal level $S_R$ according to the right channel digital single-frequency signals generated during the fourth time period T4.

In step S702, the CPU 20 compares the left channel signal level $S_L$, and the right channel signal level $S_R$, with a predetermined signal level.

In step S703, the CPU 20 determines that there is a Full Scale distortion in the left channel or the right channel if the difference between the left channel signal level $S_L$ and the predetermined signal level or the difference between the right channel signal level $S_R$ and the predetermined signal level exceeds a predetermined range.

Figure 8:
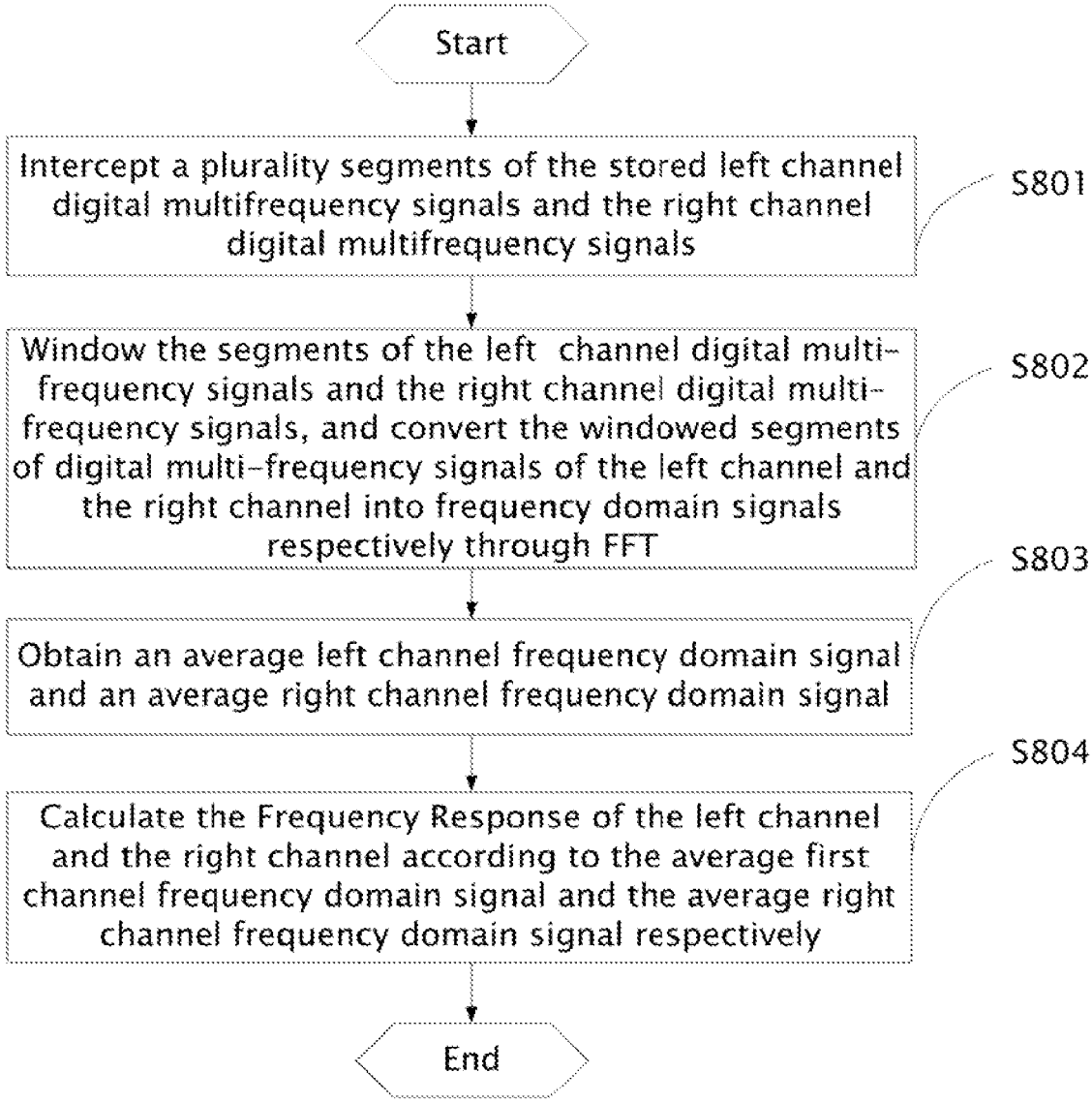
FIG. 8 is a flowchart illustrating a frequency response test method of an embodiment of the present invention.

FIG. 8 is a flowchart illustrating a frequency response test method of an embodiment of the present invention. In step S801, the CPU 20 samples a plurality of segments according to the left channel digital multi-frequency signals and a plurality of segments from the right channel digital multi-frequency signals generated during the third time period T3.

In step S802, the CPU 20 windows the segments of the left channel digital multi-frequency signals and the right channel digital multi-frequency signals, and converts the windowed segments into a plurality of left channel frequency domain signals and right channel frequency domain signals through the FFT.

In step S803, the CPU 20 calculates an average left channel frequency domain signal and an average right channel frequency domain signal.

In step S804, the CPU 20 calculates a left channel Frequency Response $FR_L$ according to the average left channel frequency domain signal o, and calculates a right channel Frequency Response $FR_R$ according to the average right channel frequency domain signal.

It is believed that the present embodiments and their advantages will be understood from the foregoing description, and it will be apparent that various changes may be made thereto without departing from the spirit and scope of the invention or sacrificing all of its material advantages, the examples hereinbefore described merely being embodiments of the invention.

What is claimed is:

1. An audio test apparatus, comprising:

a storage unit storing a media test file, wherein the media test file is configured to be played through two independent channels, and the media test file comprises a first data section, a second data section, a third data section, and a fourth data section, wherein the first data section is configured for no signal output from the first channel and the second channel when processed, the second data section is configured for outputting single-frequency signals from the first channel and no signal output from the second channel when processed, the third data section is configured for outputting multi-frequency signals from the first channel and the second channel when processed, and the fourth data section is configured for outputting single-frequency signals from the second channel and no signal output from the first channel when processed;

an audio collection device configured for receiving the signals outputted from the first channel and the second channel and converting the signals into digital signals; and a central processing unit (CPU) configured for storing the digital signals in the storage unit and performing a test according to the stored digital signals.

2. The audio test apparatus of claim 1, wherein the audio collection device is a sound card.

3. The audio test apparatus of claim 1, wherein the CPU is further configured for outputting test results to a display.

4. The audio test apparatus of claim 1, wherein the CPU is further configured for storing test results in the storage unit.

5. An audio test method comprising:

processing a media test file through two independent channels;

outputting no signal from a first channel and from a second channel in a first time period;

receiving noise signals from the first channel and the second channel, converting the received signals into first channel digital noise signals and second channel digital noise signals, and storing the first channel digital noise signals and second channel digital noise signals in a storage unit;

outputting single-frequency signals from the first channel and outputting no signal from the second channel in a second time period;

receiving the single-frequency signals from the first channel and crosstalk signals from the second channel, converting the received signals into first channel digital single-frequency signals and second channel digital crosstalk signals, and storing the first channel digital single-frequency signals and second channel digital crosstalk signals in the storage unit;

outputting multi-frequency signals from the first channel and the second channel in a third time period;

receiving multi-frequency signals from the first channel and the second channel and converting the received signals into first channel digital multi-frequency signals and second channel digital multi-frequency signals, and storing the first channel digital multi-frequency signals and second channel digital multi-frequency signals in the storage unit;

outputting no signal from the first channel and outputting single-frequency signals from the second channel in a fourth time period;

receiving crosstalk signals from the first channel and single-frequency signals from the second channel, converting the received signals into first channel digital crosstalk signals and second channel digital single-frequency signals, and storing the first channel digital crosstalk signals and second channel digital single-frequency signals in the storage unit; and performing a test according to the digital signals during the four time periods.

6. The audio test method of claim 5, further comprising at least one of:

outputting test results to a display; and storing test results in the storage unit.

7. The audio test method of claim 5, further comprising:

computing a first channel noise level and a second channel noise level according to the first channel digital noise signals and the second channel digital noise signals stored during the first time period;

computing a first channel signal level according to the first channel digital single-frequency signals stored during the second time period and computing a second channel signal level according to the second channel digital single-frequency signals that stored during the fourth time period; and calculating a signal to noise ratio (SNR) of both the first channel according to the first channel signal level and the first channel noise level and the second channel according to the second channel signal level and the second channel noise level.

8. The audio test method of claim 5, further comprising:

computing the first channel signal level according to the first channel digital single-frequency signals stored during the second time period and computing a second channel crosstalk signal level according to the second channel digital crosstalk signals stored in the second time period;

computing the second channel signal level according to the second channel digital single-frequency signals stored during the fourth time period and computing a first channel crosstalk signal level according to the first channel digital crosstalk signals stored during the fourth time period; and computing the crosstalk of the first channel according to the first channel crosstalk signal level and the first channel signal level and the crosstalk of the second channel according to the second channel crosstalk signal level and the second channel signal level.

9. The audio test method of claim 5, further comprising:

converting the first channel digital single-frequency signals and the second channel digital single-frequency signals into frequency domain signals using a Fast Fourier Transform (FFT);

obtaining amplitudes of harmonic compositions of the first channel according to the first channel frequency domain signals and obtaining amplitudes of harmonic compositions of the second channel according to the second channel frequency domain signals; and calculating the total harmonic distortion (THD) of the first channel according to the amplitudes of the harmonic compositions of the first channel and calculating the THD of the second channel according to the amplitudes of the harmonic compositions of the second channel.

10. The audio test method of claim 5, further comprising:

computing the first channel signal level according to the first channel digital single-frequency signals and the second channel signal level according to the second channel digital single-frequency signals; and comparing the first channel signal level and the second channel signal level with a predetermined signal level, and determining that Full Scale distortion exists if the difference between the first channel signal level and predetermined signal level or the difference between the second channel signal level and the predetermined signal level, exceeds a predetermined value.

11. The audio test method of claim 5, further comprising:

intercepting a plurality of segments of the first channel digital multi-frequency signals and the second channel digital multi-frequency signals and converting the intercepted segments of the first channel digital multi-frequency signals and the second channel digital multi-frequency signals into frequency domain signals through FFT;

calculating an average first channel frequency domain signal and an average second channel frequency domain signal; and calculating Frequency Response of the first channel and the second channel according to the average first channel frequency domain signal and the second channel frequency domain signal.

* * * * *